United States Patent [19]

Phillips

[11] Patent Number: 4,850,149

[45] Date of Patent: Jul. 25, 1989

[54] SHARPENING DEVICE

[76] Inventor: Jeremy F. L. Phillips, 5, Station Road, Scholar Green, Stoke-On-Trent, Staffordshire, England

[21] Appl. No.: 118,453

[22] Filed: Nov. 9, 1987

[51] Int. Cl.[4] ..... B24B 9/04; B24B 7/00

[52] U.S. Cl. ..... 51/102; 51/285

[58] Field of Search ..... 51/102, 128, 214, 285

[56] References Cited

U.S. PATENT DOCUMENTS

| | | | |
|---|---|---|---|
| 2,064,836 | 12/1936 | Johnston . | |
| 2,785,517 | 3/1957 | Brannan | 51/213 |
| 2,841,926 | 7/1958 | Lebus | 51/128 |
| 3,002,323 | 10/1961 | Adams | 51/102 |
| 4,197,677 | 4/1980 | Graves | 51/214 |

FOREIGN PATENT DOCUMENTS

| | | |
|---|---|---|
| 2550981 | 3/1985 | France . |
| 2558094 | 7/1985 | France . |

*Primary Examiner*—Bruce Y. Arnold
*Assistant Examiner*—Jay Patrick Ryan
*Attorney, Agent, or Firm*—Learman & McCulloch

[57] ABSTRACT

Device for sharpening knives and other edge tools comprises an elongate abrasive honing element, typically a rotatably driven cylindrical rod formed of or coated with an abrasive and located in a housing so as to leave only a semi-diameter of the periphery exposed, the housing including sloping guide cheeks extending upwards at each end of the exposed part of the rod to determine the angle of the blade or other workpiece during at least a final part of its passage along the rod surface.

8 Claims, 1 Drawing Sheet

SHARPENING DEVICE

This invention relates to devices for sharpening knives or other edge tools, particularly but not exclusively for domestic use e.g. in the kitchen.

The traditional method of sharpening butchers' knives and the like is by use of a hand-held steel along which the blade edges are rubbed. This can maintain a keen edge on the blade without undue blade wear or mis-shaping of its edge if used regularly in skilled hands but there is no guidance for the blade and its angle of presentation to the steel to give the most desirable sharpening action and finish is not easy to establish. Furthermore the blade is substantially exposed and in rapid movement during the sharpening action with consequent risk of injury to an unskilled user or to bystanders e.g. children.

Various electrically powered or manually operated knife sharpening devices have been proposed but these have not always proved successful or satisfactory in practice. Many of them act by inserting the blade edge into a narrow W formation to drag it along the edges of steel or abrasive discs or for it to be acted on by some kind of power driven abrasive element acting in a very localised manner on the blade edge. This can cause excessive wear of the edge so that satisfactory sharpening becomes more and more difficult and, if not used with care e.g. if excessive inward pressure is applied to the blade during use, may cause localised notching or other irregularities which can only be corrected by regrinding the blade to restore its form.

The object of the present invention is to provide a sharpening device which is of simple construction, easy and safe to use without special skills, and which is particularly efficient in maintaining a keen edge on a blade without adversely affecting its form and profile.

According to the invention there is provided a device for use in sharpening knives or other edge tools comprising an elongate abrasive honing element, a housing locating said element with a longitudinal surface thereof exposed and projecting beyond the body structure to act on the cutting edge of a blade passed along said surface, drive means for rotary or other cyclic movement of the element relative to the housing to provide a sharpening action, and at least one guide cheek of said body structure extending from a respective end of said exposed element surface at an angle thereto for use in determining the attitude of the blade during at least a final part of its passage along said surface.

Conveniently the honing element is a cylindrical rod formed of or coated with an abrasive and operatively rotated about its axis.

However, it is contemplated that other forms of honing element could be used, for example a rotatably driven endless band or an elongate strip or block which is oscillated longitudinally relative to the housing. Said movement may include a component of oscillation or rotation in other directions e.g. laterally as well as longitudinally. In the case of the rotating rod axial oscillatory motion could also be imparted thereto.

The device may be self-contained, the housing accommodating a battery operated electrically powered drive and/or it could have provision for connection to a main electric supply by means of a flexible lead.

Conveniently a pair of guide cheeks is provided at opposite ends of the element surface sloping away therefrom in opposite directions to facilitate sharpening of both sides of the blade edge to the correct angle.

An example of the invention will now be more particularly described with reference to the accompanying drawings wherein.

The device comprises a box-like hollow housing 10, conveniently formed of one or more plastics mouldings, which is rested on a table or other working surface in use.

Figure 1:
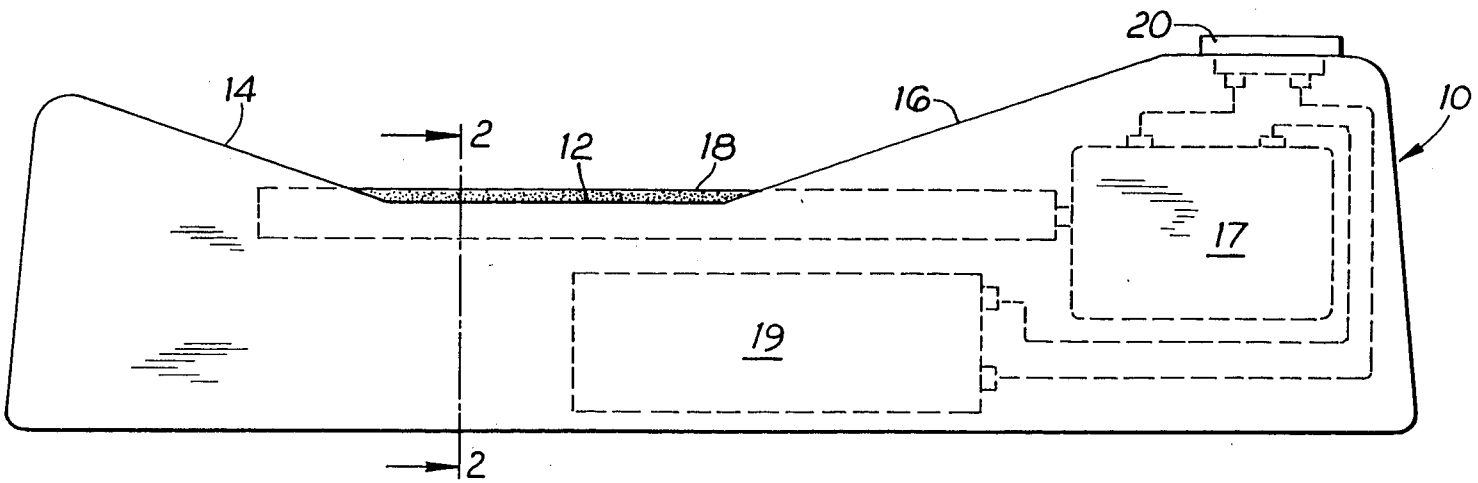
FIG. 1 is a side elevation of a self-contained sharpening device.
Figure 2:
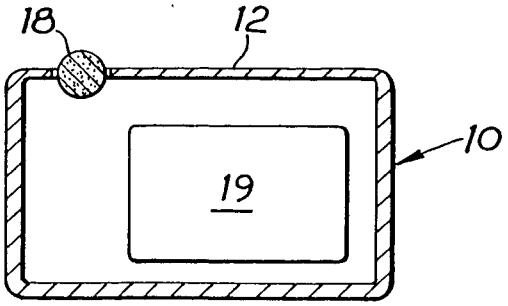
FIG. 2 is a lateral section on line 2—2 of FIG. 1.

Viewed from the side as in FIG. 1 the top surface of the housing is dished to form a wide and shallow valley having a horizontal planar median face 12 forming the valley bottom and a pair of sloping planar faces or cheeks 14, 16 forming the valley sides inclined upwardly towards raised ends of the housing top. Said cheeks slope at an angle of about 20 degrees relative to face 12 and converge toward the latter.

In this example face 12 has a length of about 50 mm and the overall width of the valley is about 150 mm including the cheeks.

Extending transversely of the valley, i.e. longitudinally of housing 10 at the valley bottom is a honing element in the form of a cylindrical rod 18, in this example formed from a fine grade abrasive composition such as that supplied under the Trade Mark or trade name "CARBORUNDUM". It is to be understood that a rod formed from a natural abrasive mineral or a composite rod of plastics or metal provided with an abrasive peripheral coating or surface could be employed, or possibly a rod in the form of a "steel" of metal having its surface treated to provide a honing or abrasive action.

The rod locates in a groove in face 12 so that about half its periphery projects beyond face 12 with its end portions located within housing 10 where it is journalled for rotation.

Housing 10 contains drive means, in this example a low voltage electric motor 17 of conventional construction for rotational of rod 18 powered from one or more batteries 19 located within housing 10 and operated by a push-button switch 20 at one end of the housing. Alternately or in addition provision may be made for powering the motor from the electric mains by way of a flexible lead.

In use motor 17 is switched on to rotate rod 18, it can be driven at a fairly high speed as the power requirement is low because of the small diameter of the rod, conveniently about 6 mm. The knife blade to be sharpened is drawn across and along the exposed peripheral surface of the rotating rod 18 in one or other direction alternately so that both sides of the edge are honed equally. During each traverse of the blade, toward the end of its travel, the back of the blade is guided by the sloping cheek 14 or 16 so that, at least as each sharpening stroke nears its end, the correct angle between the blade and the rod 18 is maintained. In this way the correct angle is provided without special skill to form and maintain a keen cutting edge. The honing action is gentle, provided the blade is kept in motion there will be no aggressive localised grinding which could damage or deform the edge, thus the knife or other tool is kept in optimum condition and given long service life.

The operation is safe in that the blade edge is generally directed downward during the sharpening action and will, in any event, be safely and positively located above the table or other working surface where accidental contact e.g. by children is much less likely.

The device is compact and, in its preferred form, self-contained and, as only intermittent operation is required, should have long battery life.

What is claimed is:

1. A device for use in sharpening the cutting edge of a knife or like tool comprising an elongate, cylindrical honing rod; a housing having a substantially planar surface; means mounting said rod in said housing with a portion of the longitudinal surface of said rod being exposed and projecting beyond said planar surface for engagement with the cutting edge of said knife or like tool; drive means for cyclically rotating said rod relative to said housing about an axis; and at least one guide cheek carried by said housing and extending laterally of said axis for supporting said knife or like tool, said cheek being inclined at such an angle to said housing surface as to support said knife or like tool with its cutting edge at a predetermined sharpening angle relative to said exposed surface of said rod as said knife or like tool is drawn across said planar surface laterally of said axis and in engagement with said exposed surface of said rod.

2. The device according to claim 1 wherein said surface of said honing rod is abrasive.

3. The device according to claim 1 wherein said driving means also axially oscillates said honing rod.

4. The device according to claim 1 wherein said housing carries a second guide cheek substantially parallel to and spaced axially of said rod from the first-mentioned cheek and inclined at such an angle to said planar surface that said cheeks converge in a direction toward said rod.

5. The device according to claim 4 wherein the inclination of each of said guide cheeks relative to said housing surface is about 20°.

6. The device according to claim 1 wherein said drive means is electrically operable, and including battery means accommodated within said housing and connected to said drive means.

7. A device for use in sharpening the cutting edge of a knife or like tool comprising a housing having a substantial planar surface; an elongate, cylindrical honing rod having an abrasive periphery; means journalling opposite ends of said rod in said housing for rotation of said rod about its axis, said housing having an opening therein between the ends of said rod and through which an intermediate portion of the periphery of said rod protrudes and projects beyond said planar surface for engagement by the cutting edge of a knife or like tool passed manually across said planar surface and laterally of said axis; drive means for cyclically rotating said rod about said axi; and a pair of guide cheeks supported by said housing at opposite ends of said intermediate portion of the periphery of said rod, each of said cheeks sloping upwardly from said housing surface at an inclination to position said knife or like tool to said rod at a predetermined sharpening angle, the inclination of said cheeks forming guide surfaces that converge in a direction toward said rod.

8. The device according to claim 7 wherein said rod has about one-half its circumference projecting beyond said planar surface.

* * * * *

UNITED STATES PATENT AND TRADEMARK OFFICE

CERTIFICATE OF CORRECTION

PATENT NO. : 4,850,149

DATED : July 25, 1989

INVENTOR(S) : Jeremy Frank Lawford Phillips

It is certified that error appears in the above-identified patent and that said Letters Patent is hereby corrected as shown below:

Column 1, line 23, change "W" to -- V --.

Column 4, line 22, change "axi" to -- axis --.

Signed and Sealed this

Twenty-ninth Day of May, 1990

*Attest:*

HARRY F. MANBECK, JR.

*Attesting Officer*

*Commissioner of Patents and Trademarks*